US011335499B2

(12) United States Patent
Suzuki

(10) Patent No.: US 11,335,499 B2
(45) Date of Patent: May 17, 2022

(54) REACTOR

(71) Applicant: TAMURA CORPORATION, Tokyo (JP)

(72) Inventor: Kotaro Suzuki, Sakado (JP)

(73) Assignee: TAMURA CORPORATION, Tokyo (JP)

( * ) Notice: Subject to any disclaimer, the term of this patent is extended or adjusted under 35 U.S.C. 154(b) by 529 days.

(21) Appl. No.: 16/233,374

(22) Filed: Dec. 27, 2018

(65) Prior Publication Data

US 2019/0206615 A1 Jul. 4, 2019

(30) Foreign Application Priority Data

Dec. 28, 2017 (JP) ..... JP2017-254906

(51) Int. Cl.

| | |
|---|---|
| ***H01F 27/24*** | (2006.01) |
| ***H01F 37/00*** | (2006.01) |
| ***H01F 3/00*** | (2006.01) |
| ***H01F 27/26*** | (2006.01) |
| ***H01F 27/06*** | (2006.01) |
| ***H01F 27/29*** | (2006.01) |
| ***H01F 27/02*** | (2006.01) |
| *H01F 27/30* | (2006.01) |
| *H01F 27/255* | (2006.01) |
| *H01F 27/32* | (2006.01) |

(52) U.S. Cl.

CPC ..... *H01F 37/00* (2013.01); *H01F 3/00* (2013.01); *H01F 27/02* (2013.01); *H01F 27/06* (2013.01); *H01F 27/26* (2013.01); *H01F 27/29* (2013.01); *H01F 27/255* (2013.01); *H01F 27/306* (2013.01); *H01F 27/325* (2013.01)

(58) Field of Classification Search

CPC ..... H01F 27/29
USPC ..... 336/212
See application file for complete search history.

(56) References Cited

U.S. PATENT DOCUMENTS

2012/0194311 A1* 8/2012 Suzuki ..... H01F 27/266 336/92
2014/0292456 A1* 10/2014 Suzuki ..... H01F 27/263 336/55
2015/0035636 A1* 2/2015 Nakatsu ..... H01F 27/2823 336/192

FOREIGN PATENT DOCUMENTS

| | | | |
|---|---|---|---|
| JP | H11297544 | A | 10/1999 |
| JP | 5424092 | A | 7/2010 |
| JP | 2013182947 | A | 9/2013 |

(Continued)

OTHER PUBLICATIONS

Office Action dated Dec. 28, 2021 for application No. JP 2017-254906 with English machine translation attached.

*Primary Examiner* — Ronald Hinson
(74) *Attorney, Agent, or Firm* — Nath, Goldberg & Meyer; Jerald L. Meyer

(57) ABSTRACT

A small size reactor that effectively utilizes a space is provided. This reactor includes: a reactor body which includes a core and a coil attached to the core, a casing which houses therein the reactor body and which has an opening where a part of the reactor body protrudes outwardly, a bus bar which is a conductive component electrically connected to the coil and which covers a part of a side of the reactor body protruding from the opening, and a terminal stage which includes an extended portion formed of a resin material where a part of the bus bar is embedded and (Continued)

provided along an edge of the opening, and which supports an electrical connection portion between the bus bar and an exterior.

8 Claims, 12 Drawing Sheets

(56) References Cited

FOREIGN PATENT DOCUMENTS

| | | | |
|---|---|---|---|
| JP | 2016039593 | A | 3/2016 |
| JP | 2016043667 | A | 4/2016 |
| JP | 2016066753 | A | 4/2016 |

* cited by examiner

REACTOR

CROSS-REFERENCE TO RELATED APPLICATION

This application is based upon and claims the benefit of priority from Japan Patent Application No. 2017-254906, filed on Dec. 28, 2017, the entire contents of which are incorporated herein by reference.

FIELD OF THE INVENTION

The present disclosure relates to a reactor.

BACKGROUND

A reactor is used for various electrical apparatuses, and includes a reactor body that includes a core and a coil wound around the circumference of the core, and a casing that houses therein the reactor body. The coil is formed by winding a conductor, in which a winding start end and a winding end become a pair of terminals to be connected to an external device. The drawn-out location of the pair of terminals may be arranged in a nearby region as disclosed in, for example, Japan Patent No. 5424092 B.

However, the interval between the pair of terminals may increase in some cases due to increased number of turns of the coil, or a coil formed by connecting plurality of single coils. Moreover, a distance from the terminal of the coil to the drawn-out location may increase due to a relation between an installation position of the reactor or an installation direction thereof, and the position of an external device.

In such cases, it is necessary to connect at least one of the terminal to a bus bar, which is a long length conductor, and extend the terminal to the drawn-out location. However, since the bus bar needs to have a clearance from the coil and the casing to ensure an electrical insulation therewith, a required space increases, and the reactor is large-sized. Even if the bus bar is thinned for downsizing, since such a bus bar is unstable and likely to vibrate, it is necessary to ensure the clearance from the coil and the casing.

SUMMARY OF THE INVENTION

The present disclosure has been made to address the aforementioned technical problems, and an objective is to provide a small size reactor that effectively utilizes a space.

A reactor according to an aspect of the present disclosure includes:

a reactor body which comprises a core and a coil attached to the core;

a casing which houses therein the reactor body and which has an opening where a part of the reactor body protrudes outwardly;

a bus bar which is a conductive component electrically connected to the coil and which covers a part of a side of the reactor body protruding from the opening; and a terminal stage which comprises an extended portion formed of a resin material where a part of the bus bar is embedded and provided along an edge of the opening, and which supports an electrical connection portion between the bus bar and an exterior.

According to the present disclosure, a small size reactor that effectively utilizes a space is provided.

DETAILED DESCRIPTION OF THE EMBODIMENTS

A reactor according to an embodiment will be described with reference to the accompanying drawings. In this specification, a Z-axis direction in FIG. 1 will be defined as an "upper" side, and the opposite direction is defined as a "lower" side. In the description of a structure of each component, the "lower" side will be also referred to as a "bottom". The Z-axis direction is an up-and-down direction of the reactor, and is a "height direction" of the reactor. Moreover, an X-axis direction in FIG. 1 and the opposite direction will be defined as a "widthwise direction", and a Y-axis direction and the opposite direction will be defined as a "depthwise direction". A plane defined by the "widthwise direction" and the "depthwise direction" will be defined as a "horizontal direction". Those directions are expressions to describe the positional relation among the components of the reactor, and are not intended to limit the positional relation and the direction when the reactor is installed on an object where the reactor is to be installed.

[Structure]

Figure 1:
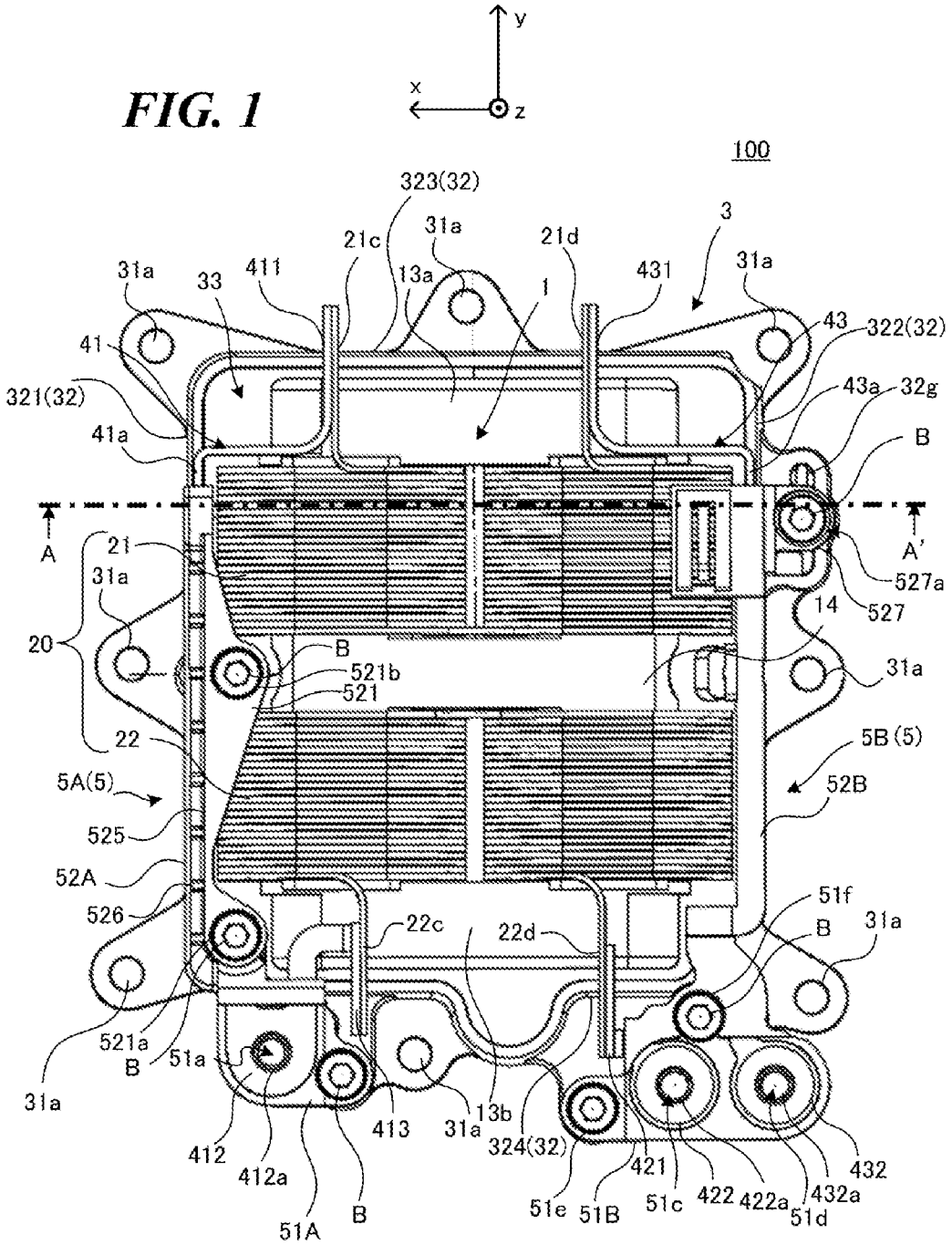
FIG. 1 is a plan view of a reactor according to an embodiment.
Figure 2:
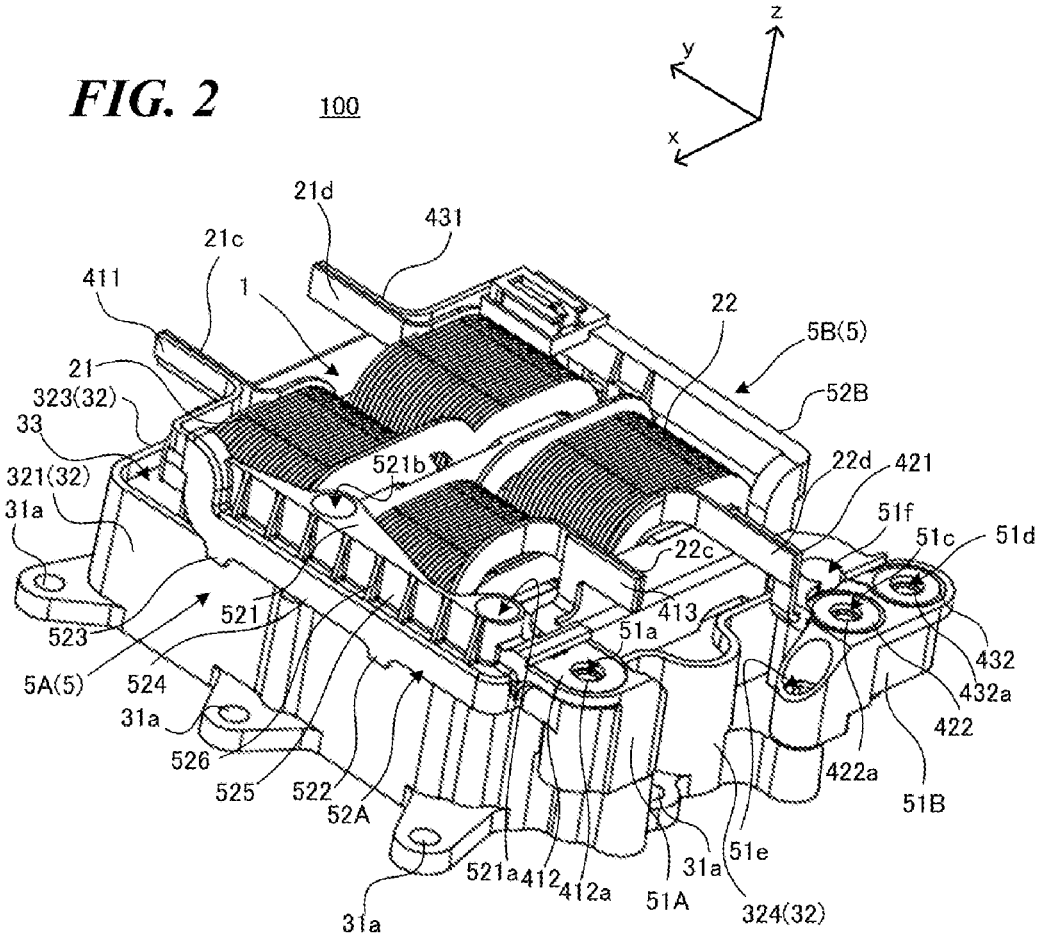
FIG. 2 is a front perspective view of the reactor according to the embodiment.

As illustrated in FIG. 1 that is a plan view and FIG. 2 that is a front perspective view, a reactor 100 includes a reactor body 1, a casing 3, bus bars 41, 42, 43 (also shown separately in FIG. 6), and a terminal stage 5.

[Reactor Body]

Figure 3:
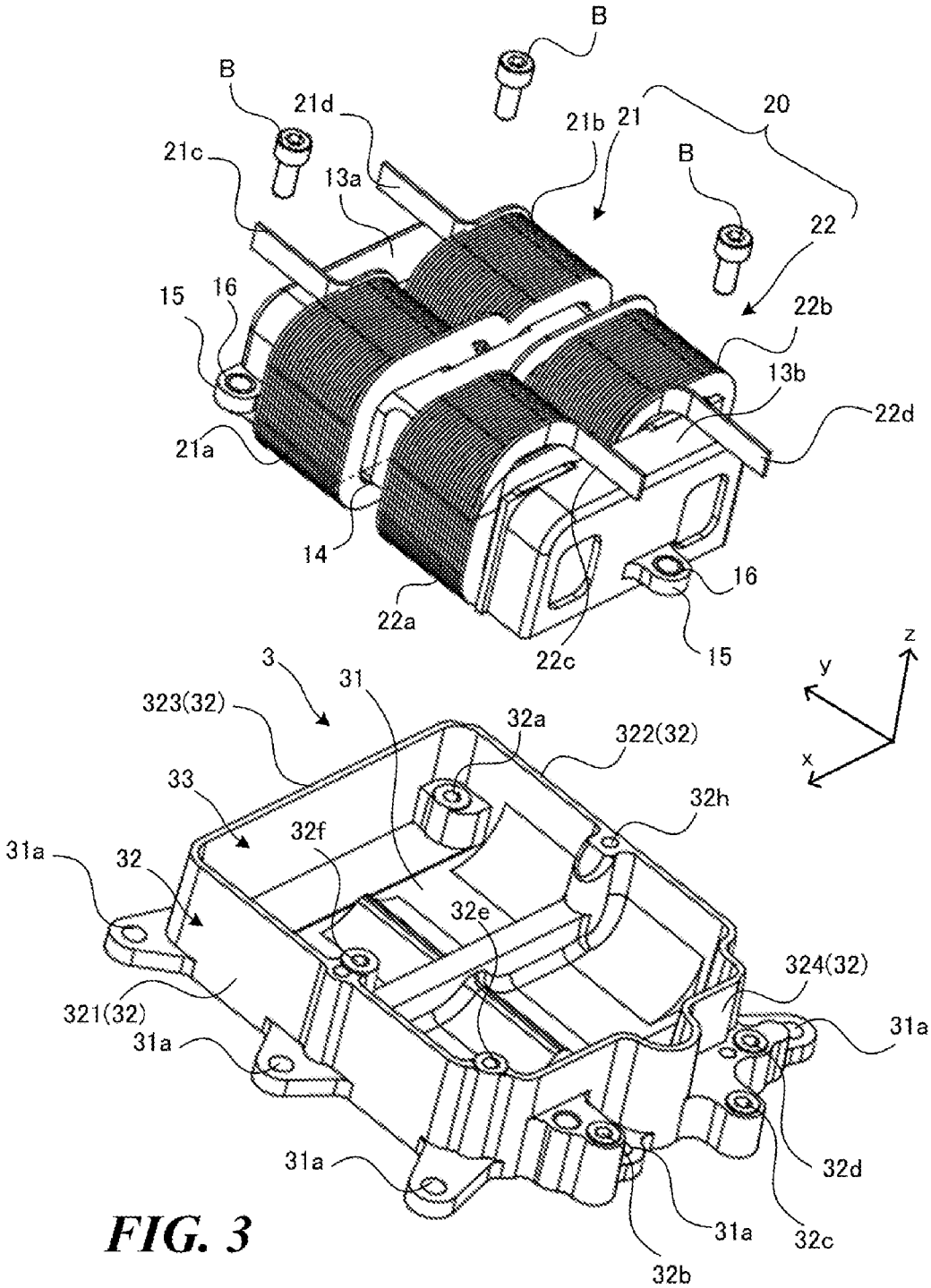
FIG. 3 is an exploded perspective view illustrating a reactor body and a casing.
Figure 4:
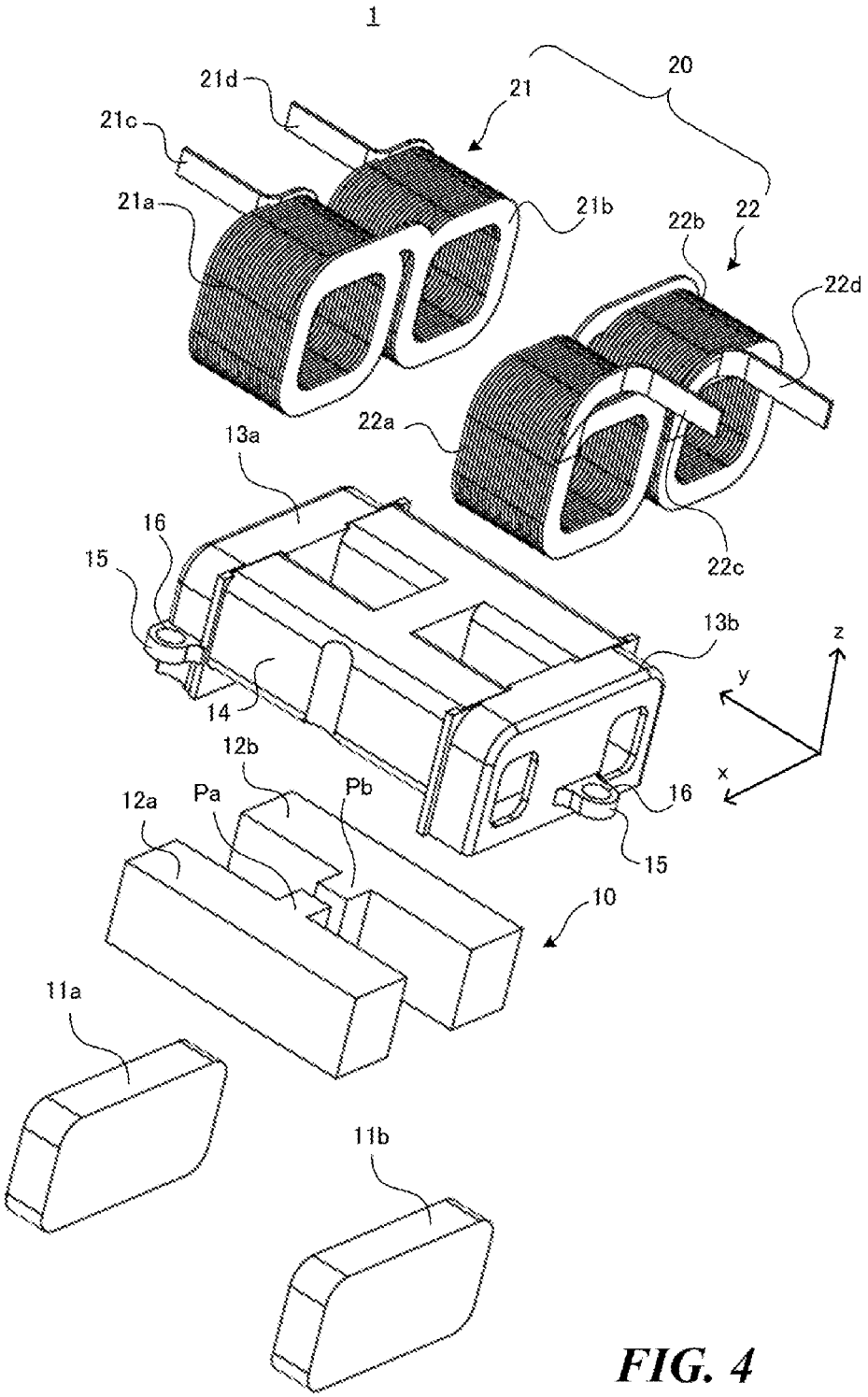
FIG. 4 is an exploded perspective view of the reactor body.

As illustrated in FIG. 1 that is a plan view and FIG. 3 that is an exploded perspective view, the reactor body 1 according to this embodiment is formed in a substantially rectangular shape with rounded corners as a whole in a plan view, and has a pair of long sides and a pair of short sides. A rectangular shape with rounded corners is a rectangle having corners thereof rounded. As illustrated in FIG. 4 that is an exploded perspective view, the reactor body 1 includes a core 10 and a coil 20.

[Core]

The core 10 is a magnetic body, such as a powder magnetic core, a ferrite magnetic core, or a laminated steel sheet, has the interior serving as a path for magnetic fluxes generated by the coil 20 to be described later and forms a magnetic circuit. More specifically, the core 10 includes two I-shaped cores 11*a* and 11*b* and two T-shaped cores 12*a* and 12*b*. The I-shaped cores 11*a* and 11*b* are each in a substantially cuboid shape. T-shaped cores 12*a* and 12*b* are each in a substantially T-shape by having center protrusions Pa and Pb formed on each side that are portions of the substantially cuboid facing with each other. The core 10 is formed in a substantially θ shape as a whole by butting and bonding respective one surfaces of the I-shaped cores 11*a* and 11*b* and respective both ends of the T-shaped cores 12*a* and 12*b* via an unillustrated adhesive.

The one surfaces of the I-shaped cores 11*a* and 11*b* and both ends of the T-shaped cores 12*a* and 12*b* may be in direct contact and butted without an adhesive, or a magnetic gap may be provided. The magnetic gap may be formed by providing a spacer or formed by a cavity.

The I-shaped cores 11*a* and 11*b* and the T-shaped cores 12*a* and 12*b* are housed in core casings 13*a* and 13*b*, and 14, respectively. The core casings 13*a*, 13*b*, and 14 are each an insulative resin mold component for insulating the core 10 from the coil 20. The I-shaped cores 11*a* and 11*b* and the T-shaped cores 12*a* and 12*b* are formed integrally with the core casings 13*a* and 13*b*, and 14, respectively, by inserting a resin in a mold and curing the inserted resin with the cores being set in the mold. That is, the I-shaped cores 11*a* and 11*b* and the T-shaped cores 12*a* and 12*b* are embedded in a material of the core casings 13*a* and 13*b*, and 14, respectively.

However, openings are provided in the core casings 13*a* and 13*b* that cover the I-shaped cores 11*a* and 11*b*, respectively, at portions corresponding to joined surfaces of the I-shaped cores 11*a* and 11*b* to the T-shaped cores 12*a* and 12*b*. Openings are provided in the core casing 14 that covers the T-shaped cores 12*a* and 12*b* at portions corresponding to joined surfaces of the T-shaped cores 12*a* and 12*b* to the I-shaped cores 11*a* and 11*b*. Engaging portions that are to be engaged with each other when the core 10 is assembled in the substantially θ shape are formed in the openings of the core casings 13*a*, 13*b*, and 14.

An end surface of the center protrusion Pa of the T-shaped core 12*a* and an end surface of the center protrusion Pb of T-shaped core 12*b* both covered by the core casing 14 face with each other via a magnetic gap that is a cavity. This magnetic gap may be formed by providing a spacer, or no magnetic gap may be formed.

A plurality of attaching portions 15 for fastening to the casing 3 are formed on the respective external surfaces of the core casings 13*a* and 13*b*. Each attaching portion 15 is a tabular piece protruding outwardly, and has an attaching hole 16 in which a bolt B is inserted formed. The bolt B is a fastener that has a screw thread. One attaching portion 15 is formed on both ends of the I-shape of the core casing 13*a*, respectively, and one attaching portion is formed on the center of the I-shaped of the core casing 13*b*. These attaching portions 15 are formed together with the molding of the core casings 13*a* and 13*b*.

[Coil]

The coil 20 is a conductive member attached to the core 10. As illustrated in FIG. 4 that is an exploded perspective view, the coil 20 according to this embodiment is an edgewise coil of a rectangular flat wire which has an insulation coating. However, the winding material of the coil 20 and the winding scheme are not limited to any particular types, and other forms may be employed.

The coil 20 includes coupled coils 21 and 22. The coupled coil 21 forms a pair of partial coils 21*a* and 21*b* using a single conductor. The coupled coil 22 forms a pair of partial coils 22*a* and 22*b* using a single conductor.

The partial coils 21*a* and 21*b* are attached to a pair of leg portions of the I-shaped core 11*a*, and to one end-side of the T-shaped cores 12*a* and 12*b* which are attached to the I-shaped core 11*a*. That is, the partial coils 21*a* and 21*b* are disposed at the I-shaped-core-11*a* side relative to the center protrusions Pa and Pb.

The partial coils 22*a* and 22*b* are attached to a pair of leg portions of the I-shaped core 11*b*, and to other end-side of the T-shaped cores 12*a* and 12*b* which are attached to the I-shaped core 11*b*. That is, the partial coils 22*a* and 22*b* are disposed at the I-shaped-core-11*b* side relative to the center protrusions Pa and Pb.

Winding start end and winding termination end 21*c* and 21*d* of the coupled coil 21 drawn out from the wound portion and winding start end and winding termination end 22*c* and 22*d* of the coupled coil 22 drawn out from the wound portion are each drawn outwardly relative to the reactor body 1. More specifically, the ends 21*c* and 21*d* extend along a long-side direction of the reactor body 1, and protrude from the one short-side. The ends 22*c* and 22*d* extend along the long-side direction of the reactor body 1, and protrude from the other short-side. The wound portion of the coil 20, that is, the wound portions of the coupled coils 21 and 22 are a portion around which a winding material is wound and which achieves the function of the coil 20, and are portion in a cylindrical shape according to this embodiment.

The coupled coil 21 and the coupled coil 22 are wound so that magnetic fluxes respectively produced are in opposite directions to each other. The wordings wound so that DC magnetic fluxes are in opposite directions to each other include a case in which the winding directions are inverted and currents in the same directions are caused to flow, and a case in which the winding direction is the same and currents in the opposite directions are caused to flow.

The reactor body 1 is formed by combining the above described core 10 and coil 20 as follow. That is, the I-shaped cores 11*a* and 11*b* and the T-shaped cores 12*a* and 12*b* embedded in the core casings 13*a* and 13*b*, and 14 are inserted in the coupled coils 21 and 22 which have been wound beforehand, and joined surfaces of the I-shaped cores 11*a* and 11*b* and those of the T-shaped cores 12*a* and 12*b* are bonded by an adhesive. Next, the engaging portions of the core casings 13*a* and 13*b*, and 14 are engaged with each other.

[Casing]

As illustrated in FIG. 3 that is an exploded perspective view, the casing 3 houses therein the reactor body 1, and has a portion where an opening 33 is formed. It is preferable that the casing 3 is formed of a material which has a high thermal conductivity and a magnetic shield effect. For example, a metal, such as aluminum, magnesium, or an alloy thereof is applicable. Moreover, the casing may not always be formed of metal, and may be formed of a resin that has an excellent thermal conductivity, or a structure in which a metal heat dissipation plate is partially embedded in such a resin. Moreover, a magnetic body is applicable to the entire casing 3 or a part of the casing. The magnetic body has a magnetic shield effect higher than that of a metal, such as aluminum.

The casing 3 includes a support 31 and a wall 32. The support 31 is a component supported by an unillustrated installation surface. In this embodiment, the support 31 is a flat-plate member in a substantially rectangular shape. Concavities and convexities along the reactor body 1 are formed on the surface of the support 31 at a side which the reactor body 1 is housed. However, the reactor body 1 is housed so that a clearance is provided between the reactor body 1 and the support 31. Moreover, fastening holes 31*a* for fastening to the installation surface are formed in the four corners of the support 31 and near centers of the long sides thereof.

The wall 32 is provided on the support 31 and stands upright, and surrounds the circumference of the reactor body 1. The wall 32 forms the opening 33 at the opposite side to the support 31. More specifically, the wall 32 includes a pair of side walls 321 and 322 in the long-side direction of the reactor body 1, and a pair of side walls 323 and 324 in the short-side direction. The space surrounded by the surfaces of the support 31 and of the wall 32 facing the reactor body 1 becomes a housing space for the reactor body 1.

The opening 33 is an opened portion formed in the wall 32 at the opposite side to the support 31. In this embodiment, the upper portion of the casing 3 is opened by the opening 33, and a part of the reactor body 1 protrudes from the casing 3 via the opening. That is, since the upper edge of the wall 32 is lower than the height of the core 10, when the reactor body 1 being housed, the upper parts of the coil 20 and the core casings 13*a*, 13*b*, and 14 protrude from the opening 33. In this embodiment, the upper half of the reactor body 1 protrudes from the edge of the opening 33.

Three attaching holes 32*a* are formed in the portions of the wall 32 corresponding to the three attaching holes 16 of the core casings 13*a* and 13*b*. Screw grooves are formed in the attaching holes 32*a*. The reactor body 1 is fastened to the casing 3 by aligning the attaching holes 16 of the core casings 13*a* and 13*b* with the respective attaching holes 32*a*, and inserting and turning in respective bolts B therein. A clearance is formed between the reactor body 1 and the support 31 of the casing 3 as described above.

Moreover, in order to attach the terminal stage 5, the casing 3 is provided with attaching holes 32*b*, 32*c*, 32*d*, 32*e*, 32*f*, and 32*g*, and a pin hole 32*h*. Screw grooves are formed in the attaching hole 32*a* to 32*g*. These attaching holes 32*a* to 32*g* and the pin hole 32*h* have axes aligned in a height direction.

The attaching holes 32*b*, 32*c*, and 32*d* are provided at the external side of the one side wall 324 parallel to a short-side direction. The attaching holes 32*e* and 32*f* are provided at the internal side of the one side wall 321 parallel to a long-side direction. The attaching hole 32*e* is provided at a boundary between the side wall 321 and the side wall 324. The attaching hole 32*f* is provided at a portion which is the center of the side wall 321 and which protrudes from the side wall 321 so that this portion enters a concaved recess of the reactor body 1 between the coupled coil 21 and the coupled coil 22.

The attaching hole 32*g* is provided at a portion of the side wall 322 protruding outwardly, and is a long hole parallel to the long-side direction. The attaching hole 32*g* is provided at a location shifted to the one side-wall-323 side from the center. The pin hole 32*h* is a hole into which a pin 528 to be described later is inserted. The pin hole 32*h* is provided at a portion which is the center of the side wall 322 and which protrudes from the side wall 322 so that this portion enters a concaved recess of the reactor body 1 between the coupled coil 21 and the coupled coil 22.

Figure 5:
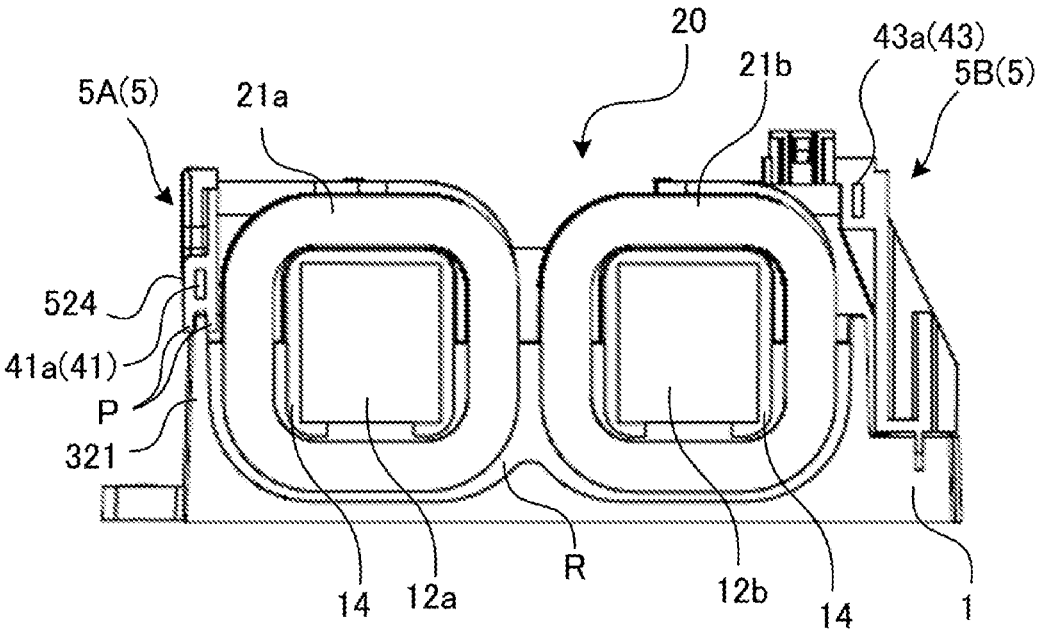
FIG. 5 is a cross-sectional view taken along a line A-A' in FIG. 1.

The housing space of the casing 3 for the reactor body 1 is filled with a filler, and the filler is cured. That is, as illustrated in FIG. 5 that is a cross-sectional view taken along a line A-A' in FIG. 1, a filler molded portion R formed by a cured filler is provided in the clearance between the casing 3 and the reactor body 1. As for the filler, a resin which is relatively soft and has a high thermal conductivity is suitable to ensure the heat dissipation performance of the reactor body 1 and to reduce vibration transmission from the reactor body 1 to the casing 3.

The coil 20 of the reactor body 1 housed in the casing 3 has a winding direction of the wound portion parallel to the edge of the opening 33 of the casing 3, that is, the wall 32. In this embodiment, the winding direction is parallel to the side walls 321 and 322 in the long-side direction of the reactor body 1.

[Bus Bar]

Figure 6:
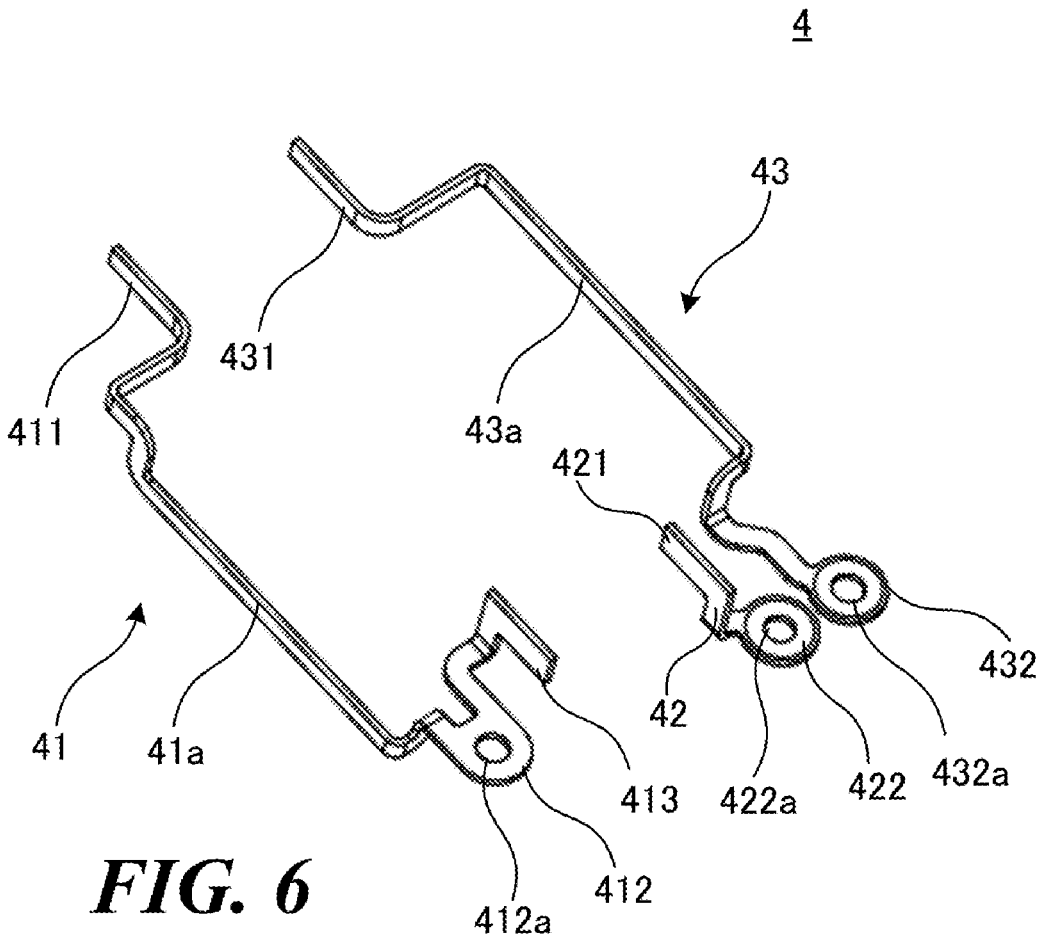
FIG. 6 is a perspective view illustrating a bus bar.

The bus bar 4 is a conductive component electrically connected to the coil 20. The bus bar 4 is provided between the coil 20 and an unillustrated external device such as an external power supply, and electrically connects both to each other. As illustrated in FIG. 6 that is a perspective view, the bus bar 4 is a long and thin bandlike component, and example materials thereof are copper, aluminum, etc.

In this embodiment, three bus bars 41, 42, and 43 are adopted. The bus bars 41 and 43 cover a part of the side of the reactor body 1 protruding from the opening 33. In this embodiment, parts of the bus bars 41 and 43 are disposed along the side of the coil 20 in parallel with the winding direction of the coil 20. Moreover, the parts of the bus bars 41 and 43 face a curved surface of the coil 20, that is, R of the outer circumference surface (see FIG. 5 and FIG. 10). More specifically, the bus bars 41 and 43 includes bandlike body portions 41*a* and 43*a* along the edge of the opening 33 of the casing 3, that is, the upper edges of the side walls 321 and 322 (see FIG. 1 and FIG. 2). These body portions 41*a* and 43*a* are formed longer than, for example, the length of the wound portion of the coil 20 in the long-side direction of the reactor body 1, that is, the length of the winding axis of the coil 20. When the plurality of coupled coils 21 and 22 are arranged in the winding axis direction like this embodiment, such a length includes all of the wound portion. One end of the bus bar 41 is a connection portion 411 connected by, for example, welding to the end 21*c* of the coupled coil 21 where the insulation coating is peeled off. The other end of the bus bar 41 is branched into two. One branched end supports an electrical connection portion at terminal 412 for connection to an external device. A terminal hole 412*a* is formed in the terminal 412. The other branched end is a connection portion 413 connected by, for example, welding to the end 22*c* of the coupled coil 22 where the insulation coating is peeled off. Hence, the terminal 412 forms an input terminal common for the coupled coils 21 and 22.

As illustrated in FIGS. 1 and 2, one end of the bus bar 42 is a connection portion 421 connected by, for example, welding to the end 22*d* of the coupled coil 22 where the insulation coating is peeled off. The other end of the bus bar 42 supports an electrical connection portion at terminal 422 for connection to an external device. A terminal hole 422*a* is formed in the terminal 422.

As illustrated in FIGS. 1 and 2, one end of the bus bar 43 is a connection portion 431 connected by, for example, welding to the end 21*d* of the coupled coil 21 where the insulation coating is peeled off. The other end of the bus bar 43 supports an electrical connection portion at terminal 432 for connection to an external device. A terminal hole 432*a* is formed in the terminal 432.

[Terminal Stage]

As illustrated in FIG. 1, the terminal stage 5 is a component that supports electrical connection portion between the bus bar 4 and the exterior. In this embodiment, a terminal stage 5A and a terminal stage 5B which are provided separately corresponding to the side of the casing 3 that faces the terminal stages.

Figure 7:
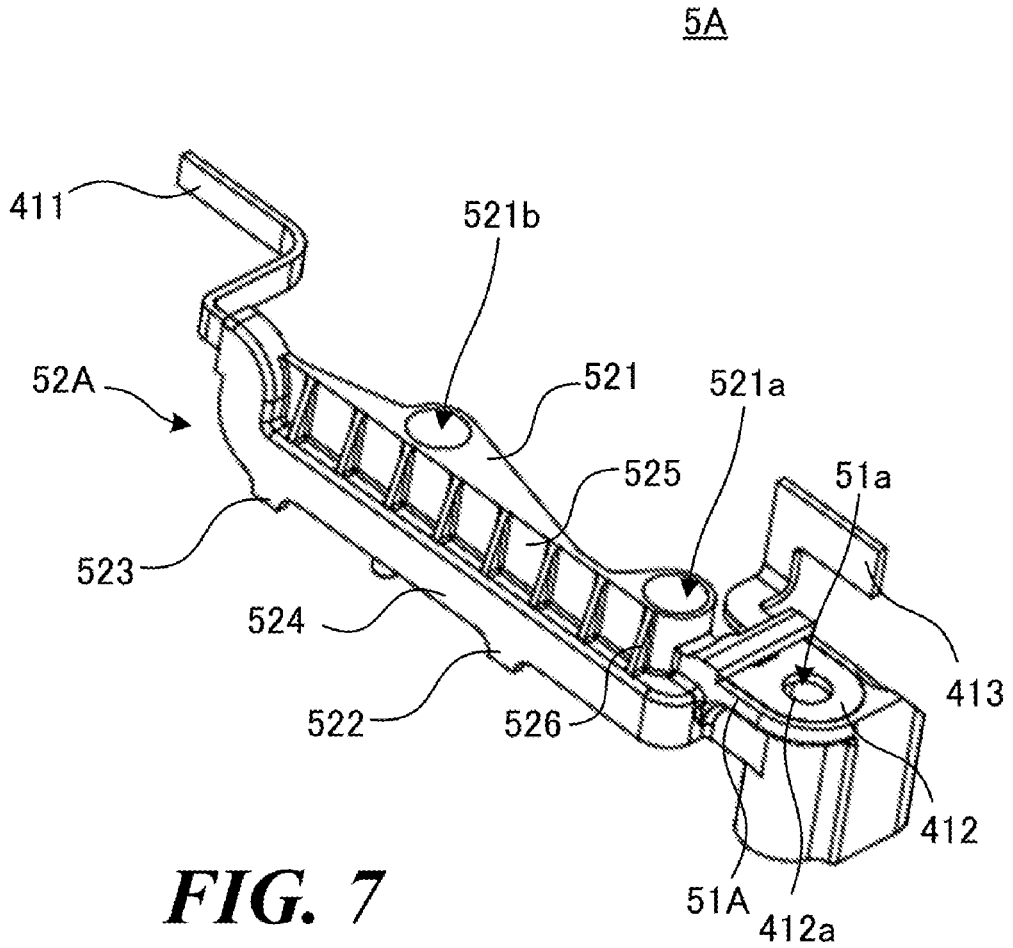
FIG. 7 is an external side perspective view of a terminal stage 5A.
Figure 12:
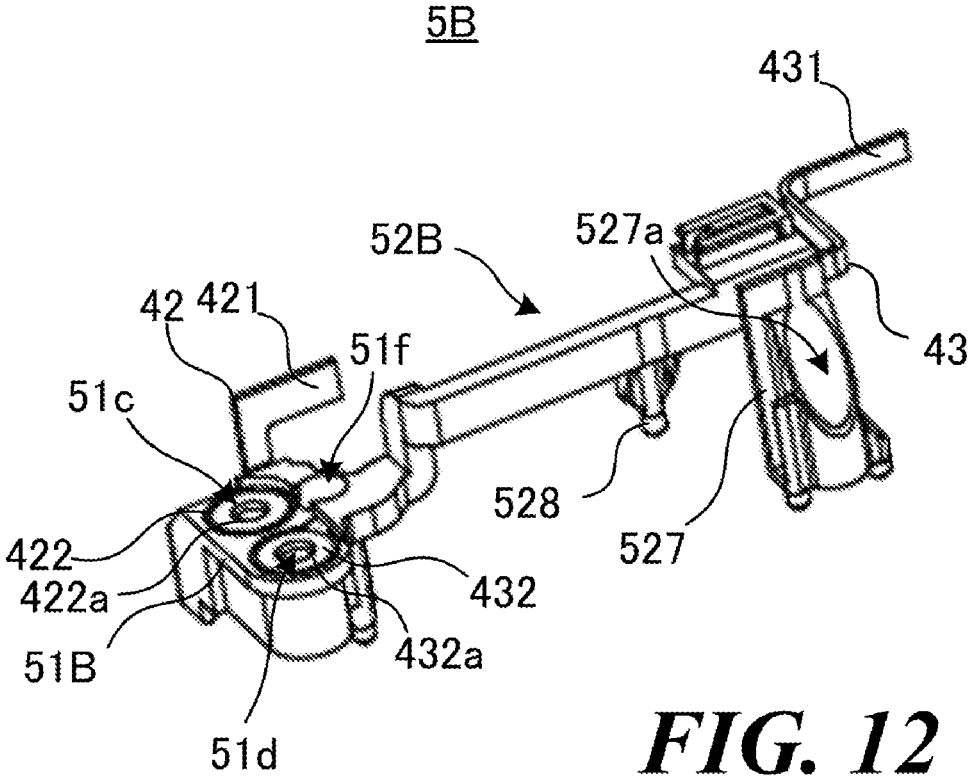
FIG. 12 is an external side perspective view of a terminal stage 5B.

The terminal stages 5A and 5B are entirely formed of a resin material. As illustrated in FIG. 7, FIG. 12 that is an external perspective view, FIG. 8, and FIG. 13 that is an internal perspective view, the terminal stages 5A and 5B include stage portions 51A and 51B and extended portions 52A and 52B. That is, the terminal stage 5A is integrally formed of a resin material and include the stage portion 51A and the extended portion 52A, and the terminal stage 5B is integrally formed of a resin material and include the stage portion 51B and the extended portion 52B. The wordings integrally formed involve a case in which both portions are formed separately and then joined together, and a case in which these portions are continuously formed without a joint.

An example resin material applied to form the terminal stages 5A and 5B is an insulation material. For example, polyphenylene sulfide (PPS), an unsaturated polyester-based resin, a urethane resin, an epoxy resin, bulk molding compound (BMP), and polybutylene terephthalate (PBT), etc., are applicable as the resin material.

Figure 8:
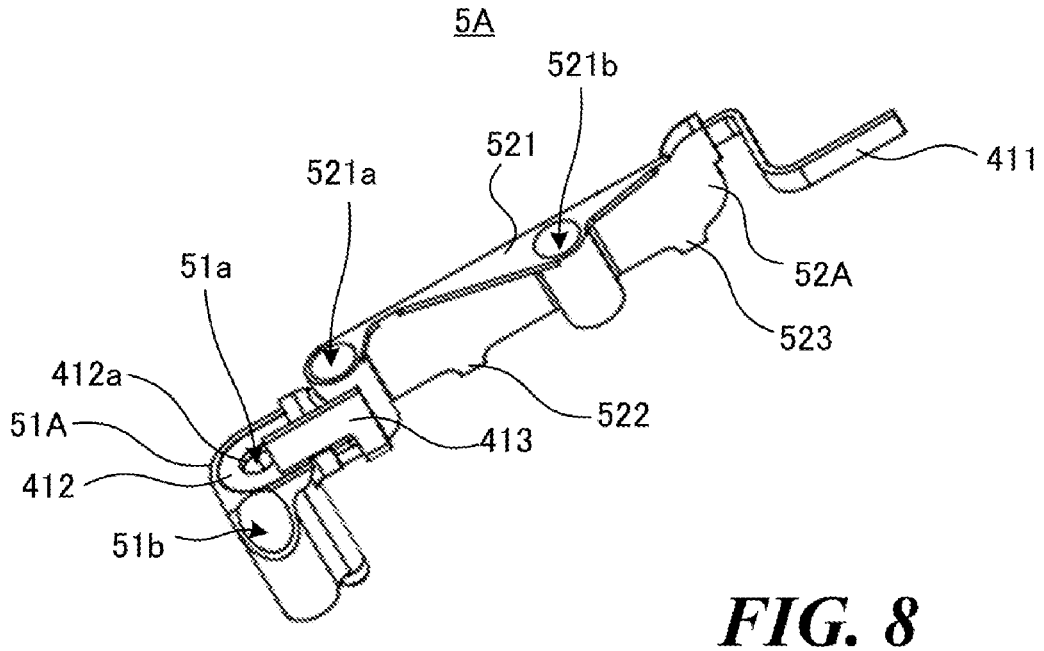
FIG. 8 is an internal side perspective view of the terminal stage 5A.

As illustrated in FIG. 7, the stage portion 51A is a stage that supports the terminal 412 of the bus bar 41. The stage portion 51A includes a surface parallel to the plane of the support 31, and the terminal 412 of the bus bar 41 is installed on this surface. A terminal hole 51*a* corresponding to the terminal hole 412*a* of the terminal 412 is formed in the stage portion 51A. Although it is not illustrated, a nut is embedded in the lower portion the terminal hole 51*a* coaxially with the terminal hole 51*a*. Moreover, as illustrated in FIG. 8, an attaching hole 51*b* is provided in the stage portion 51A at a location corresponding to the attaching hole 32*b*, of the casing 3. The attaching hole 51*b* is a hole formed at the bottom of a cylindrical shape.

The extended portion 52A is a component where the bus bars 41 is partially embedded and which is provided along the edge of the opening 33. In this embodiment, the extended portion 52A is installed to the wall 32 at the side opposite to the support 31 so that the wall 32 is extended upwardly. The extended portion 52A extends along the upper edge of the side wall 321 from the side wall 324 of the casing 3 at the one short side thereof. Hence, the extended portion 52A covers a part of the side of the reactor body 1.

The extended portion 52A includes a widespread portion 521 that protrudes horizontally to slightly cover the upper portions of the coupled coils 21 and 22. Attaching holes 521*a* and 521*b* are formed in the widespread portion 521 at locations corresponding to the attaching holes 32*e* and 32*f* of the casing 3. The attaching holes 521*a* and 521*b* are each a hole formed at the bottom of a cylindrical shape. The attaching hole 521*b* corresponding to the attaching hole 32*e* is provided at a boundary to the stage portion 51A. The attaching hole 521*b* corresponding to the attaching hole 32*f* is provided at the center of the extended portion 52A in the lengthwise direction. That is, a cylindrical shape corresponding to the attaching hole 521*b* enters a concaved recess of the reactor body 1 between the coupled coil 21 and the coupled coil 22.

Figure 9:
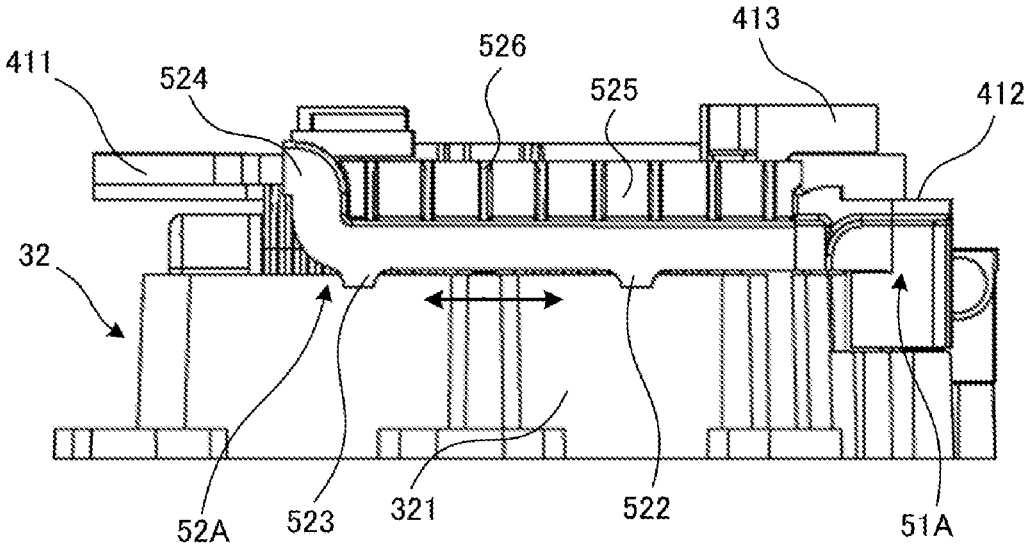
FIG. 9 is a side view of the reactor.
Figure 10:
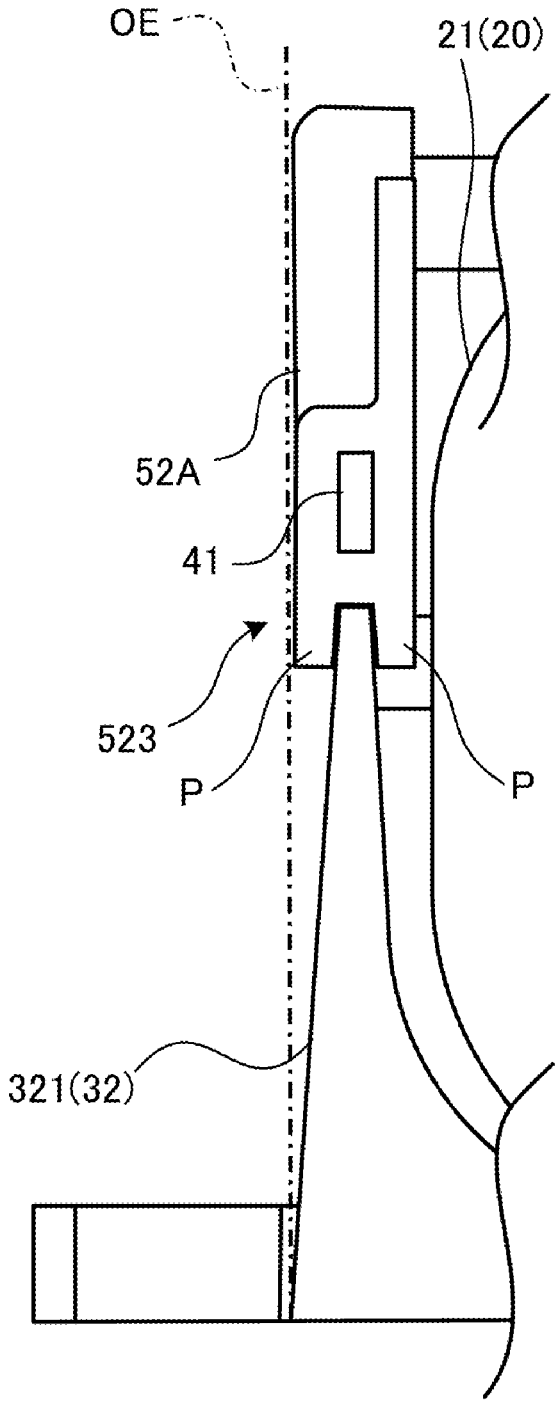
FIG. 10 is a vertical cross-sectional view illustrating a holding portion and a side wall which is apart of the cross-sectional view taken along a line A-A' in FIG. 1.

Moreover, as illustrated in FIG. 9 that is a side view, and FIG. 10 that is a cross-sectional view, the extended portion 52A includes holding portions 522 and 523 that hold the edge of the opening 33. Each of the holding portions 522 and 523 has a pair of protruding pieces P that holds therebetween the upper edge of the side wall 321 at a location facing in the thickness direction.

Figure 11:
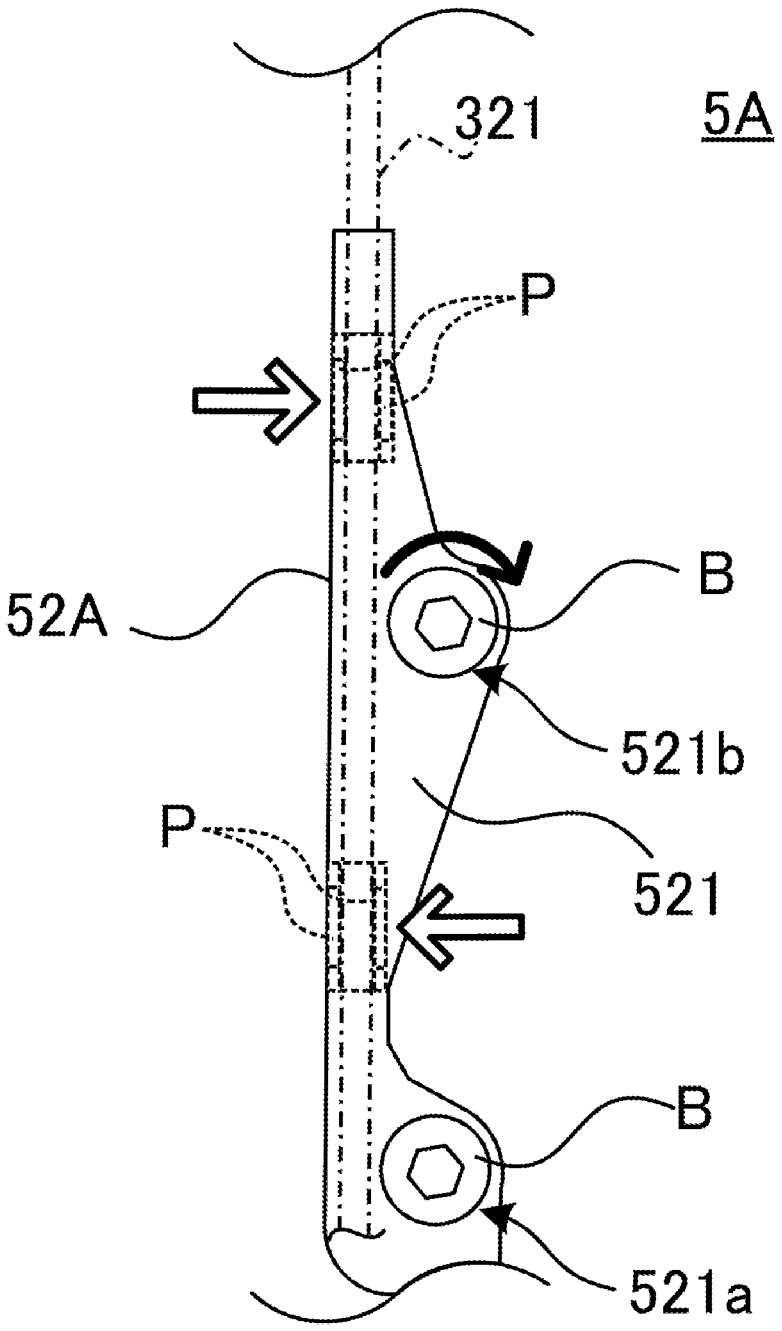
FIG. 11 is a plan view of the terminal stage 5A attached to the side wall.

As illustrated in FIG. 11 that is a plan view, the holding portions 522 and 523 are disposed so that the attaching hole 521*b* is held therebetween. That is, in the lengthwise direction of the extended portion 52A, relative to the bolt B, the holding portion 522 is disposed at one side and the holding portion 523 is disposed at the other side. When the bolt B is turned and fastened in the clockwise direction in a planar view, that is, the direction indicated by a black arrow in FIG. 11, torques are applied to the extended portion 52A in opposing directions across the side wall 321, that is, the directions indicated by white arrows in FIG. 11. The protruding pieces P of the holding portions 522 and 523 contact the internal side of the side wall 321 of the casing 3 and the external side thereof so as to restrict a turn.

Furthermore, as illustrated in FIG. 7, the bus bar 41 is partially embedded in the extended portion 52A. That is, a part of the body portion 41*a* of the bus bar 41 between the connection portion 411 and the terminal 412 is embedded in the extended portion 52A. In this embodiment, the extended portion 52A in which the bus bar 41 is embedded is disposed along the side of the coil 20 in parallel with the winding-axis direction of the coil 20. Accordingly, an embed portion 524 of the extended portion 52A in which the bus bar 41 is embedded is along the edge of the opening 33 of the casing 3 and is entirely thickened to ensure a resin thickness for insulation between the coil 20 and the casing 3. Portions of the extended portion 52A other than the embed portion 524 are a thinned portion 525 which is thinner than the embed portion 524. Ribs 526 are formed between the embed portion 524 and the thinned portion 525. That is, by forming the plurality of ribs 526 in a substantially triangular shape at an equal pitch at the corner formed by the upper portion of the embed portion 524 and the side of the thinned portion 525, the extended portion 52A is reinforced while achieving a reduction in the applied amount of the resin material and a space saving.

As illustrated in FIG. 10, an inclined surface that decreases inwardly toward the extended portion 52B from a bottom at the support-31 side is provided on the side wall 321 of the casing 3. Hence, the external edge of the extended portion 52A is disposed inwardly relative to an outer edge OE of the wall 32.

The above described terminal stage 5A is installed on the casing 3 with the attaching hole 51*b* being aligned with the attaching hole 32*b*, of the casing 3, the attaching holes 521*a* and 521*b* being aligned with the attaching holes 32*e* and 32*f* of the casing 3, and the upper edge of the side wall 321 of the casing 3 being held between the holding portions 522 and 523. Next, the terminal stage 5A is fastened to the casing 3 by inserting and turning in the bolts B in the attaching holes 51*b*, 521*a*, and 521*b*. In this embodiment, the turning direction of the bolt B for fastening is a clockwise direction in a planar view as described above. The connection portion 411 of the bus bar 41 is connected to the end 21*c* of the coupled coil 21, and the connection portion 413 of the bus bar 41 is connected to the end 22*c* of the coupled coil 22.

Figure 13:
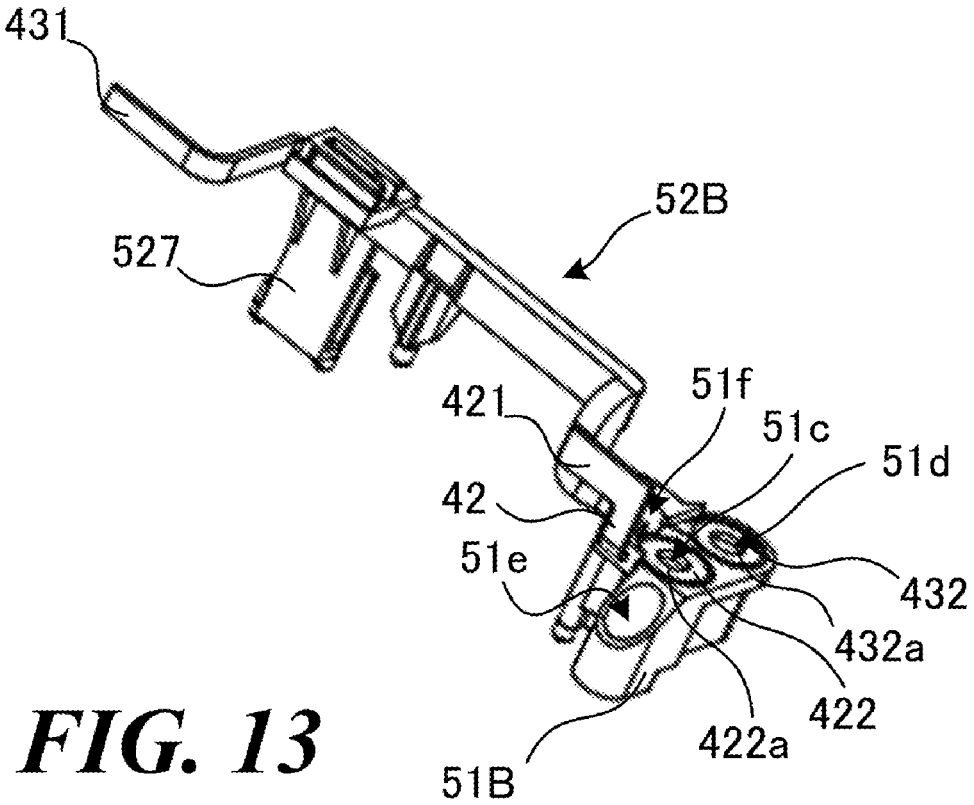
FIG. 13 is an internal side perspective view of the terminal stage 5B.

As illustrated in FIG. 12B, the stage portion 51B supports the terminals 422 and 432 which are parts of the bus bars 42 and 43. The stage portion 51B has a surface parallel to the plane of the support 31, and the terminal 422 of the bus bar 42 and the terminal 432 of the bus bar 43 are installed on the surface. Two terminal holes 51*c* and 51*d* corresponding to the terminal hole 422*a* of the terminal 422 and the terminal hole 432*a* of the terminal 432 are formed in the stage portion 51B. Although it is not illustrated in the figure, nuts are embedded in the lower portions of the terminal holes 51*c* and 51*d* coaxially with the terminal holes 51*c* and 51*d*. Moreover, as illustrated in FIG. 13, attaching holes 51*e* and 51*f* are provided in the stage portion 51B at locations corresponding to the attaching holes 32*c* and 32*d* of the casing 3. The attaching holes 51*e* and 51*f* are each a hole formed at a bottom of a cylindrical shape. Furthermore, a portion of the bus bar 42 between the connection portion 421 and the terminal 422 is embedded in the stage portion 51B.

The extended portion 52B is a component in which a body portion 43*a* that is a part of the bus bar 43 is embedded, and which is provided along the edge of the opening 33. The extended portion 52B is installed to the wall 32 at the side opposite to the support 31 so that the wall 32 is extended upwardly. The extended portion 52B is extended along the upper edge of the side wall 322 from the side wall 324 of the casing at the one short side direction. Hence, the extended portion 52B covers a part of the side of the reactor body 1. In this embodiment, the extended portion 52B in which the bus bar 43 is embedded is disposed along the side of the coil 20 in parallel with the winding axis direction of the coil 20.

The extended portion 52B includes a widespread portion 527 that protrudes outwardly relative to the casing 3. An attaching hole 527*a* is formed in the widespread portion 527 at a location corresponding to the attaching hole 32*g* of the casing 3. Moreover, the pin 528 is inserted in the extended portion 52B at a location corresponding to the pin hole 32*h* of the casing 3. Furthermore, the bus bar 43 is partially embedded in the extended portion 52B. That is, a portion of the bus bar 43 between the connection portion 431 and the terminal 432 is embedded in the extended portion 52B.

The above described terminal stage 5B is installed on the casing 3 with the attaching holes 51*e* and 51*f* being aligned with the attaching holes 32*c* and 32*d* of the casing 3, the attaching hole 527*a* being aligned with the attaching hole 32*g*, and the pin 528 being inserted in the pin hole 32*h*. Moreover, the terminal stage 5B is fastened to the casing 3 by inserting and turning in the bolts B in the attaching holes 51*e*, 51*f*, and 527*a*. The connection portion 421 of the bus bar 42 is connected to the end 22*d* of the coupled coil 22, and the connection portion 431 of the bus bar 43 is connected to the end 21*d* of the coupled coil 21.

[Action and Effect]

(1) The reactor 100 according to this embodiment includes the reactor body 1 that includes the core 10 and the coil 20 attached to the core 10, the casing 3 which houses therein the reactor body 1 and which has the opening 33 where a part of the reactor body 1 protrudes outwardly, the bus bar 41 which is a conductive component electrically connected to the coil 20 and which covers apart of the side of the reactor body 1 protruding from the opening 33, and the terminal stage 5A which includes the extended portion 52A formed of a resin material where a part of the bus bar 41 is embedded and provided along the edge of the opening 33, and which supports an electrical connection portion between the bus bar 41 and the exterior.

As described above, by disposing the bus bar 41 to partially cover the side of the reactor body 1 protruding from the casing 3, a dead space near the upper portion of the casing 3 and the protruding portion of the reactor body 1 is effectively utilized, and by embedding the bus bar 41 in the extended portion 52A which is formed of a resin material and along the edge of the opening 33, a vibration is prevented and an electrical insulation is ensured. As a result, the bus bar 41 can be disposed at a location proximal to the coil 20 and to the casing 3, enabling a downsizing of the reactor 100. Furthermore, since the bus bar 41 and the extended portion 52A in which this bus bar is partially embedded only cover the protruding portion of the reactor body 1 from the casing 3, the opening 33 is maintained opened, and heat from the reactor body 1 is avoided from being trapped in the casing 3, thereby preventing a deterioration due to overheating.

(2) The terminal stage 5 is integrally formed of a resin material and includes the extended portion 52A. Hence, since the extended portion 52A where the bus bar 41 is embedded is integrally formed with the terminal stage 5, the number of assembling process can be reduced in comparison with a case in which the bus bar 41 and the terminal stage 5 are separately attached to the casing 3 from. Although vibration of the reactor body 1 is separately transmitted when the terminal stage 5 and extended portion 52A are separate components, since the terminal stage 5, the extended portion 52A, and also the bus bar 41 are integral with each other according to this embodiment, the effect by vibration can be reduced.

(3) The terminal stage 5 includes the stage portion 51A that supports the electrical connection portion between the bus bar 41 and the exterior, and at least one of the connection ends of the coil 20 to the bus bar 41 and the stage portion 51A are disposed at locations corresponding to the opposing two sides of the casing 3 and apart from each other. Hence, although it is necessary to make the bus bar 41 long, since such a bus bar is partially embedded in the extended portion 52A, vibration of the bus bar is prevented and an electrical insulation from the coil 20 and the casing 3 is maintained.

(4) The extended portion 52A includes the holding portions 522 and 523 which hold therebetween the edge of the opening 33. This facilitates positioning of the extended portion 52A at the time of attaching. Moreover, for example, when the bolts B and the pin 528 are applied for fastening, it is necessary to form the side wall 321 of the casing 3 thick to form holes at such locations. However, when there is no leeway in a space between the thickened location and the reactor body 1, it is necessary to enlarge the casing 3 outwardly. In contrast, according to this embodiment, since the holding portions 522 and 523 simply hold therebetween the edge of the opening 33, the side wall 321 of the casing 3 can be made thin. For example, as illustrated in FIG. 10, by causing the side wall 321 to have an inclination, the outer edge of the extended portion 52A is located inwardly relative to the outer edge OE of the side wall 321, and the downsizing is enabled. Furthermore, since the extended portion 52A is supported by the casing 3 by causing the holding portions 522 and 523 to hold the extended portion 52A, problems due to variability in size of each component, and thermal expansion thereof can be addressed. For example, when the bus bar 41 is long, for a reason such that, in general, thermal expansion increases in proportion to the length and dimension of an object, effects of thermal expansion and variability in size increase. According to this embodiment, however, since thermal expansion and variability are reduced even if the bus bar 41 is long, the effect becomes more improved.

(5) The extended portion 52A is fastened to the edge of the opening 33 of the casing 3 by the bolt B which has a screw thread, and the holding portions 522 and 523 are provided at locations that contact the internal side of the casing 3 and the external side thereof with the bolt B being present between the holding portions so that rotation of the extended portion 52A in the fastening direction of the bolt B is restricted. This prevents the extended portion 52A from being distorted due to torque applied when the bolt B is turned in and fastened.

(6) The holding portions 522 and 523 have the pair of protruding pieces P that holds therebetween the edge of the opening 33 at locations facing with each other in the thickness direction. Therefore, since the protruding pieces P face with each other in the thickness direction and holds the edge of the opening 33 therebetween, the distortion of the extended portion 52A can be corrected along the edge of the opening 33.

(7) A part of the bus bar 41 is disposed along the side of the coil in parallel with the winding axis of the coil 20. Since the coil 20 and the bus bar 41 have the same electrical potential, these can be disposed proximal to each other, enabling downsizing. Furthermore, a part of the bus bar 41 faces the curved surface of the coil 20. This enables formation of a clearance along the curved surface while proximally disposing the bus bar 41 and the coil 20, ensuring an electrical insulation.

Other Embodiments

The present disclosure is not limited to the above described embodiment, and covers other embodiments to be described below. Moreover, the present disclosure also covers a form in which the above described embodiment and all of or some of the other embodiments to be described below are combined. Furthermore, various omissions, replacements, and modifications can be made without departing from the scope of the present disclosure, and such modified forms are also within the scope of the present disclosure.

Figure 14:
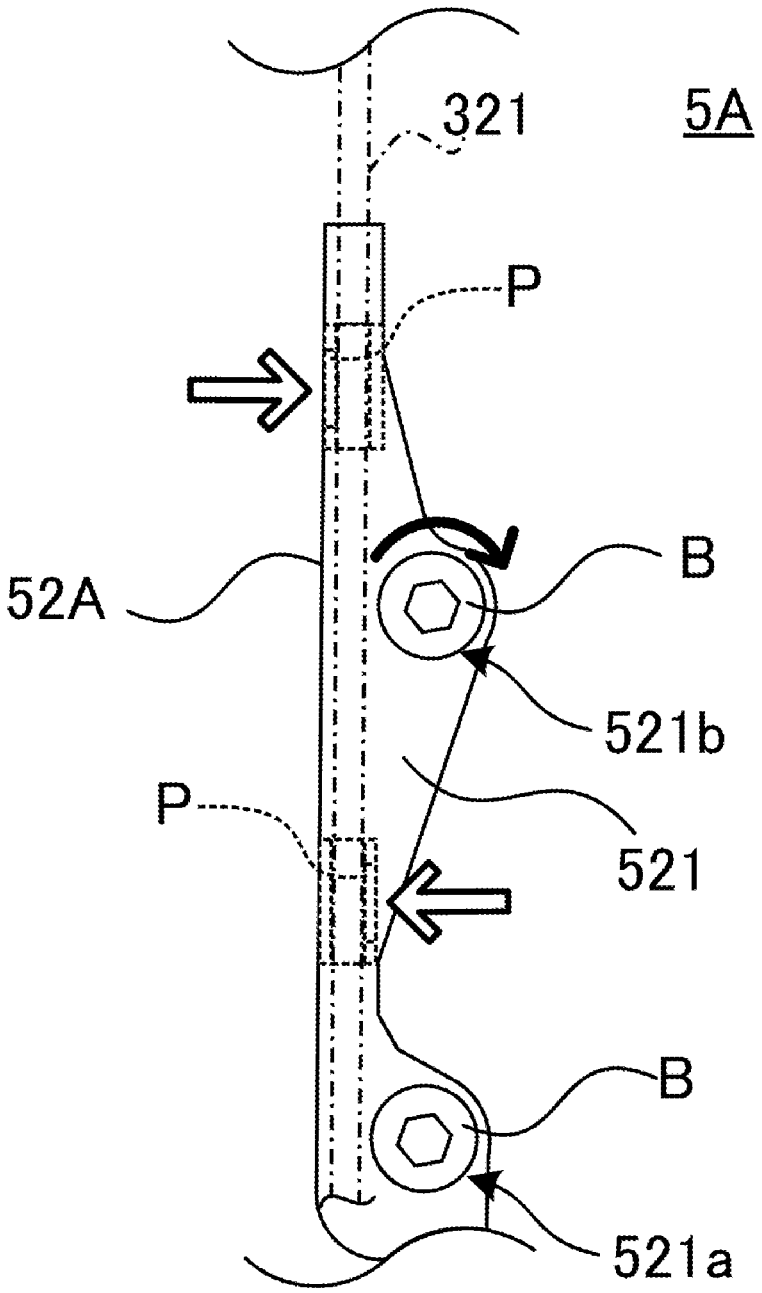
FIG. 14 is a plan view illustrating another form of the holding portion.

(1) The holding by the protruding pieces P of the holding portions 522 and 523 facing with each other in the thickness direction of the opening 33 may not always be necessary. As described above, in order to prevent the distortion by torque applied when the bolts B are fastened, as illustrated in FIG. 14, it is appropriate if one protruding piece P is each present at the internal side of the side wall 321 and at the external side thereof. That is, the wording "hold" is not limited to a case in which protruding pieces face with each other in the thickness direction of the wall 32, and the location to hold the wall 32 may be shifted in the long-side direction. For example, as illustrated in FIG. 14, a case in which the holding portions 522 and 523 each have one protruding piece P can also be considered as a case in which the edge of the opening 33 is held although there is a shift in the Y-axis direction. Hence, such holding portions 522 and 523 can be considered as a set, and that there is one holding portion that holds the edge of the opening 33. Moreover, a holding portion formed of a protruding piece extended continuously in the long-side direction may be provided. In order to prevent the entire distortion of the extended portion 52A, however, it is appropriate if there are a plurality of holding portions each having a relatively-short protruding piece.

(2) The shapes, numbers, etc., of the core 10 and coil 20 of the reactor body 1 are not limited to the above examples. The core 10 may be formed of a combination of a pair of C-shaped cores, or may be a combination of a C-shaped core and an I-shaped core. The coil 20 may be formed by the pair of coils 21 and 22 that employ a simple winding structure. For example, the core 10 may be a combination of a pair of C-shaped cores, and the coil 20 may be the pair of coupled coils 21 and 22.

(3) The number, disposing location, etc., of the bus bar 4 is not limited to those in the above described embodiment. In this embodiment, only the one terminal stage 5A is fastened to the casing 3 by the holding portions 522 and 523, but the other terminal stage 5B may be fastened using the holding portions, to achieve downsizing from both sides of the casing 3. Moreover, the two extended portions 52A and 52B may form the terminal stage that includes a single common stage portion.

(4) The relation between the winding direction of the coil 20 and the direction along the short-side, and the lengthwise direction of the bus bar 4 is not limited to the above described example. A case in which a part of the bus bar 4 is disposed so as to be orthogonal to the winding direction of the coil 20 is also included in the case in which the bus bar is disposed along the side of the reactor body 1. For example, in the case of the coil 20 that has a pair of partial coils disposed have the winding axis parallel to each other, respective ends of the partial coils drawn out in the winding axis direction may be connected with each other by the bus bar 4 orthogonal to the winding axis direction. Furthermore, the bus bar 4 may be disposed in the direction along the long-side direction of the reactor body 1, or may be disposed in the direction along the short-side direction. The location of the stage portion of the terminal stage 5 may be at the short-side of the casing 3, or may be at the long-side.

What is claimed is:

1. A reactor comprising:

a reactor body which comprises a core and a coil attached to the core;

a casing which houses therein the reactor body and which has an opening where a part of the reactor body protrudes outwardly;

a bus bar which is a conductive component electrically connected to the coil and which covers a part of a side of the reactor body protruding from the opening;

a terminal stage which comprises an extended portion formed of a resin material where a part of the bus bar is embedded and provided along an edge of the opening while maintaining the opening in an open state, and which supports an electrical connection portion between the bus bar and an external device, wherein a portion of the bus bar is disposed along a side of the coil in parallel with a winding axis direction of the coil;

the extended portion comprises holding portions that hold therebetween the edge of the opening;

the extended portion is fastened to the edge of the opening of the casing by a fastener which has a screw thread; and the holding portions are provided at locations that contact an internal side of the casing and an external side thereof with the fastener being present therebetween to restrict rotation of the extended portion in a fastening direction of the fastener.

2. The reactor according to claim 1, wherein the terminal stage is integrally formed of a resin material and include the extended portion.

3. The reactor according to claim 1, wherein:

the terminal stage comprises a stage portion which supports the electrical connection portion between the bus bar and the exterior; and at least one of connection ends of the coil to the bus bar, and the stage portion are disposed at locations corresponding to opposing two sides of the casing and are apart from each other.

4. The reactor according to claim 1, wherein a portion of the bus bar faces a curved surface of the coil.

5. A reactor comprising:

a reactor body which comprises a core and a coil attached to the core;

a casing which houses therein the reactor body and which has an opening where a part of the reactor body protrudes outwardly;

a bus bar which is a conductive component electrically connected to the coil and which covers a part of a side of the reactor body protruding from the opening;

a terminal stage which comprises an extended portion formed of a resin material where a part of the bus bar is embedded and provided along an edge of the opening while maintaining the opening in an open state, and which supports an electrical connection portion between the bus bar and an external device, wherein a portion of the bus bar is disposed along a side of the coil in parallel with a winding axis direction of the coil;

the extended portion comprises holding portions that hold therebetween the edge of the opening; and the holding portions have a pair of protruding pieces that holds therebetween the edge of the opening at locations facing with each other in a thickness direction.

6. The reactor according to claim 5, wherein the terminal stage is integrally formed of a resin material and include the extended portion.

7. The reactor according to claim 5, wherein:

the terminal stage comprises a stage portion which supports the electrical connection portion between the bus bar and the exterior; and at least one of connection ends of the coil to the bus bar, and the stage portion are disposed at locations corresponding to opposing two sides of the casing and are apart from each other.

8. The reactor according to claim 5, wherein a portion of the bus bar faces a curved surface of the coil.

* * * * *